US011270831B2

(12) United States Patent
Maeda et al.

(10) Patent No.: US 11,270,831 B2
(45) Date of Patent: Mar. 8, 2022

(54) THREE-PHASE REACTOR COMPRISING IRON-CORE UNITS AND COILS

(71) Applicant: FANUC CORPORATION, Yamanashi (JP)

(72) Inventors: Takuya Maeda, Yamanashi (JP); Masatomo Shirouzu, Yamanashi (JP)

(73) Assignee: FANUC CORPORATION, Yamanashi (JP)

( * ) Notice: Subject to any disclaimer, the term of this patent is extended or adjusted under 35 U.S.C. 154(b) by 0 days.

(21) Appl. No.: 15/930,715

(22) Filed: May 13, 2020

(65) Prior Publication Data

US 2020/0294703 A1 Sep. 17, 2020

Related U.S. Application Data

(62) Division of application No. 15/265,929, filed on Sep. 15, 2016, now Pat. No. 10,734,153.

(30) Foreign Application Priority Data

Sep. 17, 2015 (JP) ..... JP2015-184474
Feb. 3, 2016 (JP) ..... JP2016-018822

(51) Int. Cl.

| | |
|---|---|
| ***H01F 27/24*** | (2006.01) |
| ***H01F 27/26*** | (2006.01) |
| ***H01F 27/245*** | (2006.01) |
| ***H01F 27/255*** | (2006.01) |

(52) U.S. Cl.
CPC ..... *H01F 27/263* (2013.01); *H01F 27/245* (2013.01); *H01F 27/255* (2013.01)

(58) Field of Classification Search
CPC .... H01F 27/263; H01F 27/255; H01F 27/245; H01F 37/00; H01F 30/12; H01F 2038/426; H01F 3/14
See application file for complete search history.

(56) References Cited

U.S. PATENT DOCUMENTS

| | | | | |
|---|---|---|---|---|
| 526,063 A | | 9/1894 | Wagemann | |
| 1,098,664 A | * | 6/1914 | Dobrowolsky | H01F 17/06 336/175 |
| 1,150,416 A | * | 8/1915 | Bogen et al. | H02M 7/068 307/58 |
| 2,406,704 A | * | 8/1946 | Mossay | H01F 30/12 336/5 |
| 3,067,374 A | * | 12/1962 | Nygard | H01F 30/12 363/140 |

(Continued)

FOREIGN PATENT DOCUMENTS

| | | |
|---|---|---|
| DE | 19604192 A1 | 9/1996 |
| JP | 5373352 A | 6/1978 |

(Continued)

OTHER PUBLICATIONS

English Abstract and Machine Translation for Japanese Publication No. 2015-159657 A, published Sep. 3, 2015, 58 pgs.

(Continued)

*Primary Examiner* — Mang Tin Bik Lian

(74) *Attorney, Agent, or Firm* — Fredriksen & Byron, P.A.

(57) ABSTRACT

A three-phase reactor includes: a central iron core; an outer peripheral iron core surrounding the central iron core; and at least three connecting units that magnetically connect the central iron core and the outer peripheral iron core to each other, in which each of the connecting units includes at least one connecting iron core, at least one coil wound around the connecting iron core, and at least one gap.

4 Claims, 12 Drawing Sheets

(56) References Cited

U.S. PATENT DOCUMENTS

| | | | | |
|---|---|---|---|---|
| 4,156,897 | A | 5/1979 | Vigh et al. | |
| 4,912,618 | A * | 3/1990 | Krinickas, Jr. | H01F 27/303 363/37 |
| 7,235,910 | B2 * | 6/2007 | Decristofaro | H01F 1/15375 310/216.065 |
| 2009/0058584 | A1 * | 3/2009 | Rastogi | H01F 27/24 336/5 |
| 2009/0121820 | A1 | 5/2009 | Tatematsu et al. | |
| 2013/0187741 | A1 * | 7/2013 | Goodrich | H01F 30/12 336/170 |
| 2015/0123479 | A1 | 5/2015 | Kurita | |
| 2016/0111207 | A1 * | 4/2016 | Habraken | H01F 38/14 336/212 |
| 2016/0125998 | A1 * | 5/2016 | Bhide | H01F 27/263 336/5 |

FOREIGN PATENT DOCUMENTS

| | | | |
|---|---|---|---|
| JP | 2203507 | A | 8/1990 |
| JP | 2010252539 | A | 11/2010 |
| JP | 2013074084 | A | 4/2013 |
| JP | 2015159657 | A | 9/2015 |
| JP | 2018177500 | A | 11/2018 |
| WO | 2014033830 | A1 | 3/2014 |
| WO | 2015125416 | A1 | 8/2015 |

OTHER PUBLICATIONS

English Abstract and Machine Translation for Japanese Publication No. 2013-074084 A, published Apr. 22, 2013, 15 pgs.

English Abstract and Machine Translation for Japanese Publication No. 2010-252539 A, published Nov. 4, 2010, 18 pgs.

English Abstract and Machine Translation for Japanese Publication No. 2018-177500 A, published Jul. 31, 2018, 17 pgs.

English Abstract and Machine Translation for Japanese Publication No. 2203507 A, published Aug. 13, 1990, 4 pgs., 7 pages.

English Abstract and Machine Translation for German Publication No. 19604192 A, published Sep. 5, 1996, 4 pgs.

English Machine Translation for Japanese Publication No. 53-073352 A, published Jun. 29, 1978, 2 pgs.

* cited by examiner

THREE-PHASE REACTOR COMPRISING IRON-CORE UNITS AND COILS

RELATED APPLICATIONS

This application is a divisional application of U.S. application Ser. No. 15/265,929, filed Sep. 15, 2016, which claims priority to Japanese Application No. 2016-018822, filed Feb. 3, 2016 and Japanese Application No. 2015-184474, filed Sep. 17, 2015, the contents of which are incorporated herein.

BACKGROUND OF THE INVENTION

1. Field of the Invention

The present invention relates to a three-phase reactor including iron-core units and coils.

2. Description of the Related Art

Ordinarily, three-phase reactors include three iron cores and three coils wound around the iron cores. Japanese Laid-open Patent Publication No. 2-203507 discloses a three-phase reactor including three coils placed side by side. International Publication No. WO 2014/033830 discloses that the corresponding central axes of plural coils are arranged around the central axis of a three-phase reactor. Japanese Laid-open Patent Publication No. 2008-177500 discloses a three-phase reactor including plural straight magnetic cores that are radially arranged, connecting magnetic cores that connect the straight magnetic cores, and coils that are wound around the straight magnetic cores and the connecting magnetic cores.

SUMMARY OF THE INVENTION

A three-phase alternating current passes through a coil in each phase of a three-phase reactor. In conventional three-phase reactors, the length of a magnetic path through which magnetism generated when currents pass through coils in two optional phases passes may depend on the combination of the phases. Accordingly, there has been a problem that even when three-phase alternating currents in equilibrium are passed through the corresponding phases of a three-phase reactor, the densities of magnetic fluxes passing through iron cores in the corresponding phases are different from each other, and inductances are also imbalanced.

In the conventional three-phase reactors, it may be impossible to symmetrically arrange iron-core coils in corresponding phases. Therefore, magnetic fluxes generated from the iron-core coils cause imbalanced inductances. When inductances are imbalanced in a three-phase reactor as described above, it is impossible to ideally output a three-phase alternating current even if the three-phase alternating current is ideally inputted.

In the conventional three-phase reactors, the sizes of gaps (thicknesses of gaps) depend on the sizes of commercially available gap materials. Therefore, the winding number and cross-sectional area of a coil may be limited by the size of a gap material when the structure of a three-phase reactor is determined. The precision of an inductance in a three-phase reactor depends on the precision of the thickness of a gap material. Since the precision of the thickness of a gap material is commonly around ±10%, the precision of an inductance in a three-phase reactor is also dependent thereon. It is also possible to produce a gap material having a desired size while the cost of the gap material is increased.

In order to assemble a three-phase reactor, a step of assembling the core members of the three-phase reactor on a one-by-one basis, and a step of connecting some core members to each other are preferably performed several times. Therefore, it is difficult to control the size of a gap. In addition, a manufacturing cost is increased by improving the precision of the thickness of a gap material.

A core member is ordinarily formed by layering plural steel sheets for layering. A three-phase reactor preferably has a portion in which core members come in contact with each other. In addition, it is preferable to alternately layer the steel sheets for layering in order to enhance the precision of the contact portion. Such operations have been very complicated.

Further, the conventional three-phase reactors have a problem that a magnetic field leaks out to an air area around a coil in such a three-phase reactor because the coil is exposed to the outside. The magnetic field that has leaked out can influence the operation of a heart pacemaker, and can have an influence such as heating of a magnetic substance around such a three-phase reactor. In recent years, amplifiers, motors, and the like have tended to be driven by higher-frequency switching. Therefore, the frequency of high-frequency noise has tended to be higher. Thus, the influence of the magnetic field that has leaked out on the outside may be greater.

The problem that the inductance is imbalanced can be solved by enlarging only the gap of a central phase. However, a magnetic field is allowed to further leak out by enlarging the gap.

The present invention was accomplished under such circumstances with an object to provide a three-phase reactor that prevents an inductance from being imbalanced and a magnetic field from leaking out to the outside.

In order to achieve the object described above, according to a first aspect of the present invention, there is provided a three-phase reactor including: a central iron core; an outer peripheral iron core surrounding the central iron core; and at least three connecting units that magnetically connect the central iron core and the outer peripheral iron core to each other, wherein each of the connecting units includes at least one connecting iron core, at least one coil wound around the connecting iron core, and at least one gap.

According to a second aspect of the present invention, the number of the connecting units is a multiple of 3 in the first aspect of the present invention.

According to a third aspect of the present invention, the connecting units are spaced from both the central iron core and the outer peripheral iron core in either the first or second aspect of the present invention.

According to a fourth aspect of the present invention, the connecting units come in contact with both the central iron core and the outer peripheral iron core, or the connecting units are integrated with both the central iron core and the outer peripheral iron core in either the first or second aspect of the present invention.

According to a fifth aspect of the present invention, the connecting units come in contact with only either the central iron core or the outer peripheral iron core, or the connecting units are integrated with either the central iron core or the outer peripheral iron core in either the first or second aspect of the present invention.

According to a sixth aspect of the present invention, the coil is wound by concentrated winding in any of the first to fifth aspects of the present invention.

According to a seventh aspect of the present invention, the coil is wound by distributed winding in any of the first to fifth aspects of the present invention.

According to an eighth aspect of the present invention, the plural coils exist and are connected in at least either series or parallel in any of the first to seventh aspects of the present invention.

According to a ninth aspect of the present invention, an extending unit that circumferentially extends is disposed on at least one end of each of the connecting units in any of the first to eighth aspects of the present invention.

According to a tenth aspect of the present invention, the three-phase reactor includes: a first set including at least three connecting units; and a second set including at least three other connecting units in any of the first to ninth aspects of the present invention. The number of sets may be two or more.

According to an eleventh aspect of the present invention, the connecting units of the three-phase circuit reactor are arranged rotationally symmetrically with respect to the central iron core in any of the first to tenth aspects of the present invention.

According to a twelfth aspect of the present invention, the outer peripheral iron core includes plural outer peripheral iron core units in any of the first to eleventh aspects of the present invention.

According to a thirteenth aspect of the present invention, an outer peripheral gap is formed between outer peripheral iron core units adjacent to each other, of the plural outer peripheral iron core units in the twelfth aspect of the present invention.

The objects, features, and advantages as well as other objects, features, and advantages of the present invention will become clear due to detailed descriptions of exemplary embodiments of the present invention illustrated in the accompanying drawings.

DETAILED DESCRIPTION

Figure 1A:
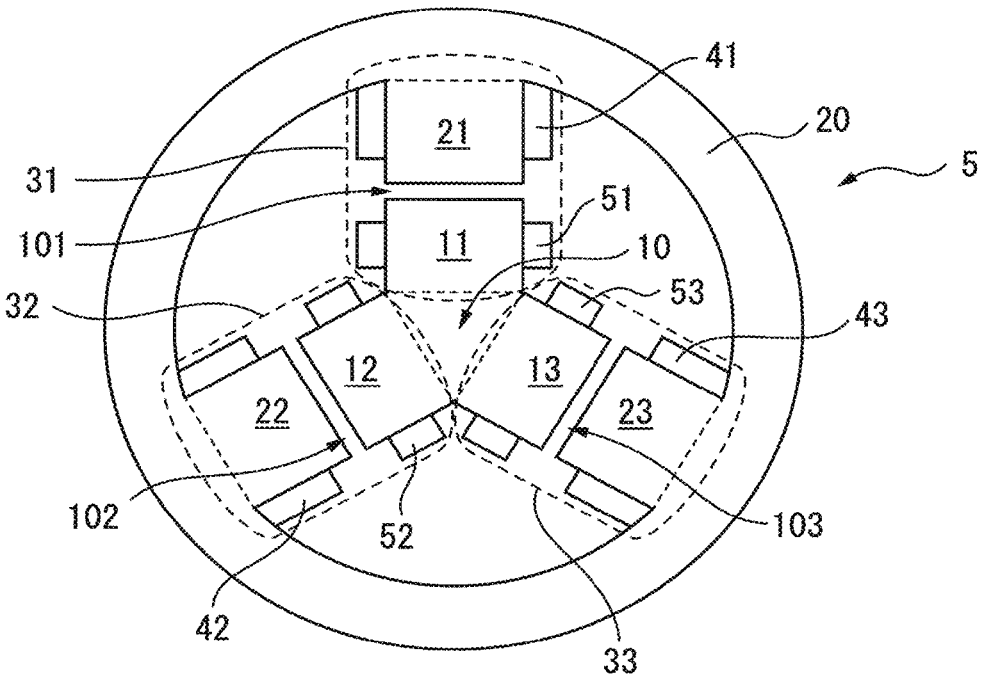
FIG. 1A is a cross-sectional view of a three-phase reactor according to a first embodiment of the present invention.

Embodiments of the present invention will be described below with reference to the accompanying drawings. In the following drawings, similar members are denoted by similar reference characters. The reduction scales of the drawings are varied as appropriate in order to facilitate understanding.

Figure 1B:
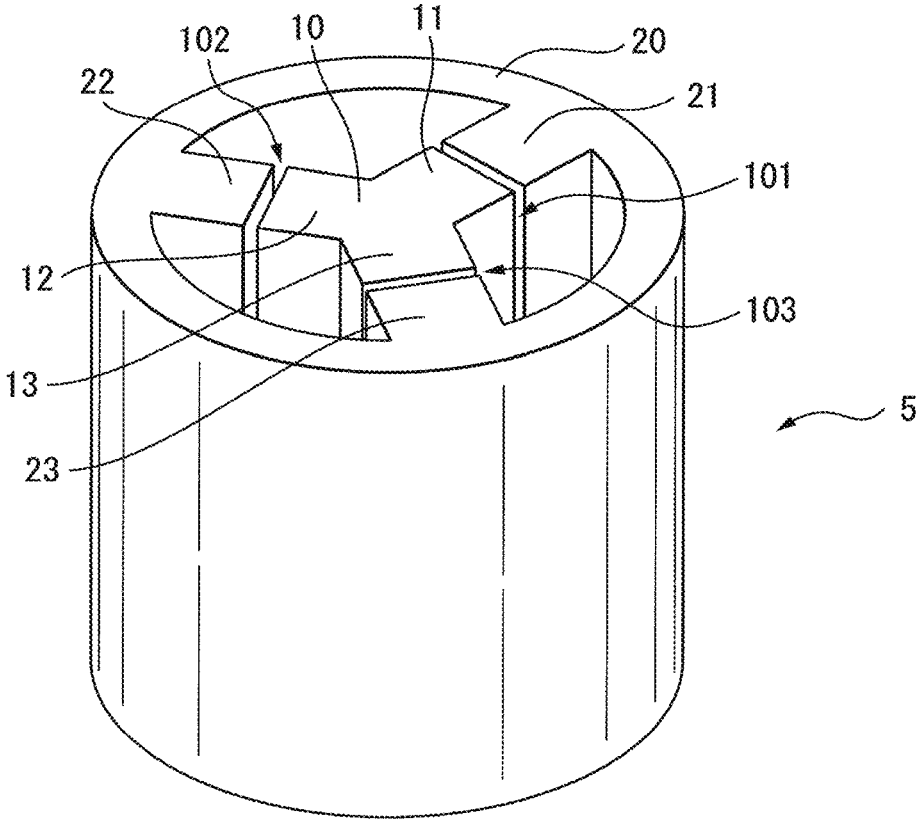
FIG. 1B is a perspective view in which coils are excluded from the three-phase reactor illustrated in FIG. 1A.

FIG. 1A is a cross-sectional view of a three-phase reactor according to a first embodiment of the present invention. FIG. 1B is a perspective view of the three-phase reactor illustrated in FIG. 1A. As illustrated in FIG. 1A and FIG. 1B, the three-phase reactor 5 includes a central iron core 10, an outer peripheral iron core 20 surrounding the central iron core 10, and at least three connecting units 31 to 33 that magnetically connect the central iron core 10 and the outer peripheral iron core 20 to each other. In FIG. 1A, the central iron core 10 is arranged at the center of the outer peripheral iron core 20 having a ring shape. As described above, the shapes of the central iron core 10 and the outer peripheral iron core 20 are greatly different from each other in the present invention.

The central iron core 10, the outer peripheral iron core 20, and the connecting units 31 to 33 are produced by layering plural iron sheets, carbon steel sheets, and electromagnetic steel sheets, or produced from a magnetic material such as a ferrite or a pressed powder core. The outer peripheral iron core 20 may be integral, or the outer peripheral iron core 20 may be dividable into plural small portions. Further, the number of the connecting units 31 to 33 may be a multiple of 3. For example, the number of the connecting units may be six, as described later.

As illustrated in FIG. 1, the connecting units 31 to 33 include connecting iron cores 11 to 13, respectively, coming in contact with the central iron core 10. The connecting iron cores 11 to 13 are spaced from each other circumferentially at regular intervals. Further, the connecting units 31 to 33 include connecting iron cores 21 to 23, respectively, coming in contact with the inner peripheral surface of the outer peripheral iron core 20. The connecting iron cores 21 to 23 are also spaced from each other circumferentially at regular intervals. Accordingly, the connecting units 31 to 33 are spaced from each other circumferentially at regular intervals. The connecting iron cores 21 to 23 and the connecting iron cores 11 to 13 face each other, respectively. The connecting iron cores 11 to 13 may be members that are different from the central iron core 10, or that are integrated with the central iron core 10. Similarly, the connecting iron cores 21 to 23 may be members that are different from the outer peripheral iron core 20, or that are integrated with the outer peripheral iron core 20. The same applies to the other embodiments described later.

The connecting unit 31 described above includes the connecting iron core 11 coming in contact with the central iron core 10, the connecting iron core 21 coming in contact with the outer peripheral iron core 20, and a gap 101 formed to enable magnetic connection between the connecting iron core 11 and the connecting iron core 21.

Similarly, the connecting unit 32 includes the connecting iron core 12 coming in contact with the central iron core 10, the connecting iron core 22 coming in contact with the outer peripheral iron core 20, and a gap 102 formed to enable magnetic connection between the connecting iron core 12 and the connecting iron core 22. Further, the connecting unit 33 similarly includes the connecting iron core 13 coming in contact with central iron core 10, the connecting iron core 23 coming in contact with the outer peripheral iron core 20, and a gap 103 formed to enable magnetic connection between the connecting iron core 13 and the connecting iron core 23. As illustrated in FIG. 1A, in the first embodiment, both of an end surface of the connecting iron core 11 and an end surface of the connecting iron core 21 are flat. As a result, the gap 101 is linear or rectangular. The other gaps 102 and 103 also have similar configurations. A gap material including an insulator may be inserted into the gaps 101 to 103 of the three-phase reactor 5 in the present invention.

Further, as illustrated in FIG. 1A, coils 51, 41 are wound around the connecting iron cores 11, 21 of the connecting unit 31, respectively. Similarly, coils 52, 42 are also wound around the connecting iron cores 12, 22 of the connecting unit 32, respectively. Similarly, coils 53, 43 are also wound around the connecting iron cores 13, 23 of the connecting unit 33. In FIG. 1B, illustrations of the coils are omitted for the purpose of making the drawing brief and clear.

The central iron core 10 and the outer peripheral iron core 20 are coupled to each other in both end surfaces of the three-phase reactor 5. In such a case, the end surfaces of the three-phase reactor 5 are magnetically shielded depending on a purpose. When the end surfaces are magnetically shielded, the coils are invisible from the end surfaces of the three-phase reactor 5. In contrast, when the end surfaces are not magnetically shielded, the coils are visible from the end surfaces of the three-phase reactor 5.

In the present invention, the central iron core 10 is arranged at the center of the outer peripheral iron core 20, and the connecting units 31 to 33 are spaced from each other circumferentially at regular intervals. Accordingly, in the present invention, the coils 41 to 53 and the gaps 101 to 103 in the connecting units 31 to 33 are also spaced from each other circumferentially at regular intervals, and the three-phase reactor 5 in itself has a rotationally-symmetrical structure.

Therefore, magnetic fluxes typically concentrate at the center of the three-phase reactor 5, and the total of the magnetic fluxes at the center of the three-phase reactor 5 is zero in a three-phase alternating current. Accordingly, in the present invention, differences in magnetic path lengths between phases are equalized, and an imbalance in inductances caused by the differences in the magnetic path lengths can be eliminated. Further, an imbalance in magnetic fluxes generated from the coils can also be eliminated, and therefore, an imbalance in inductances caused by the imbalance in the magnetic fluxes can be eliminated.

In the present invention, steel sheets are die-cut with high precision and are layered with high precision by swaging or the like, whereby the central iron core 10, the outer peripheral iron core 20, and the connecting units 31 to 33 can be produced with high precision. As a result, the central iron core 10, the outer peripheral iron core 20, and the connecting units 31 to 33 can be assembled together with high precision, and the sizes of the gaps can be controlled with high precision.

In other words, in the present invention, the gaps having optional sizes can be inexpensively formed with high precision in the connecting units 31 to 33 between the central iron core 10 and the outer peripheral iron core 20. Accordingly, in the present invention, the freedom of design of the three-phase reactor 5 can be improved. As a result, the precision of inductance is also improved.

In the present invention, the connecting units 31 to 33 including the coils 41 to 53 and the gaps 101 to 103 are surrounded by the outer peripheral iron core 20. Therefore, in the present invention, a magnetic field and magnetic flux do not leak out to the outside of the outer peripheral iron core 20, and high-frequency noise can be greatly reduced.

Figure 2A:
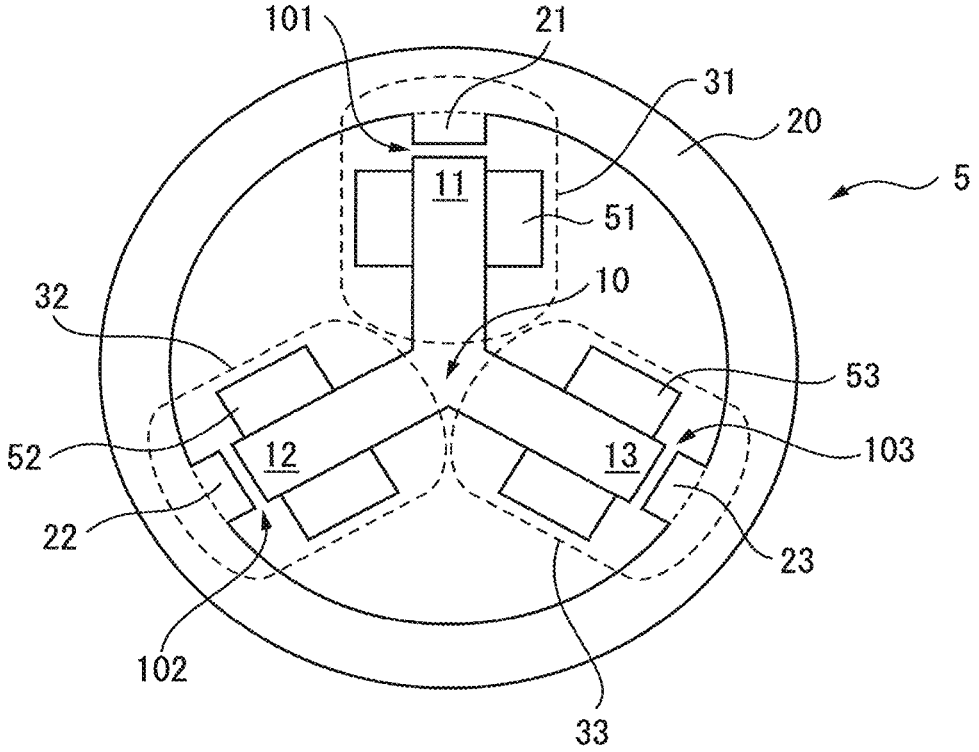
FIG. 2A is a cross-sectional view of a three-phase reactor according to a second embodiment of the present invention.

FIG. 2A is a cross-sectional view of a three-phase reactor according to a second embodiment of the present invention. In FIG. 2A, connecting iron cores 11 to 13 included in connecting units 31 to 33 are longer than the connecting iron cores 11 to 13 included in the connecting units 31 to 33 illustrated in FIG. 1. Connecting iron cores 21 to 23 included in the connecting units 31 to 33 are shorter than the connecting iron cores 21 to 23 included in the connecting units 31 to 33 illustrated in FIG. 1. Coils 51 to 53 are wound around the connecting iron cores 11 to 13, while no coils are wound around the connecting iron cores 21 to 23.

Figure 2B:
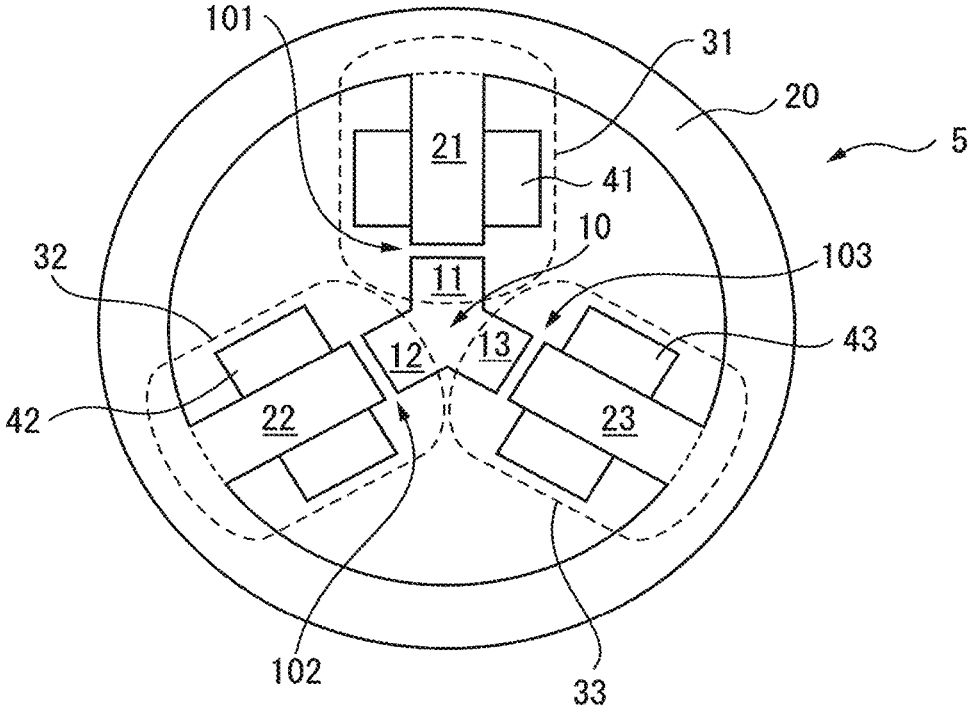
FIG. 2B is a cross-sectional view of another three-phase reactor according to the second embodiment of the present invention.

FIG. 2B is a cross-sectional view of another three-phase reactor according to the second embodiment of the present invention. In FIG. 2B, connecting iron cores 11 to 13 in connecting units 31 to 33 are shorter than the connecting iron cores 11 to 13 in the connecting units 31 to 33 illustrated in FIG. 1. Connecting iron cores 21 to 23 in the connecting units 31 to 33 are longer than the connecting iron cores 21 to 23 in the connecting units 31 to 33 illustrated in FIG. 1. In FIG. 2B, no coils are wound around the connecting iron cores 11 to 13, while coils 41 to 43 are wound around the connecting iron cores 21 to 23.

In the configuration illustrated in each of FIG. 2A and FIG. 2B, the number of the coils is small, and therefore, the structure of the three-phase reactor 5 is simplified to facilitate manufacture of the three-phase reactor 5. It is obvious that effects similar to the effects described above can be obtained.

Figure 3A:
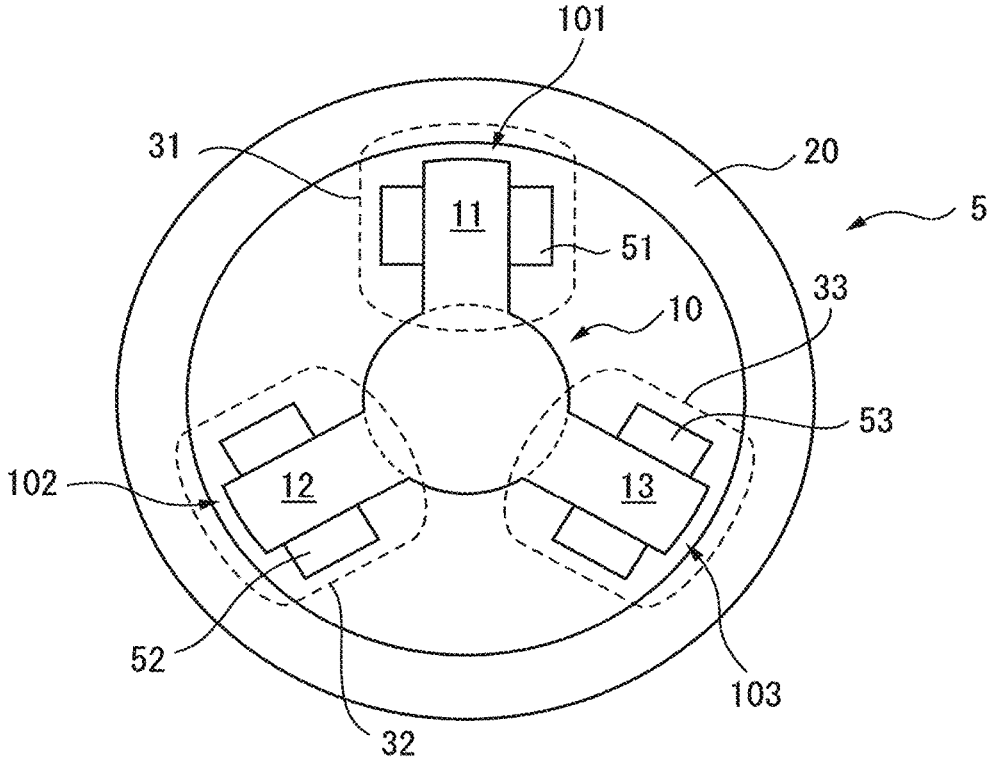
FIG. 3A is a cross-sectional view of a three-phase reactor according to a third embodiment of the present invention.

FIG. 3A is a cross-sectional view of a three-phase reactor according to a third embodiment of the present invention. Connecting units 31 to 33 in FIG. 3A include only connecting iron cores 11 to 13 but do not include connecting iron cores 21 to 23. The connecting iron cores 11 to 13 extend to the vicinity of the inner peripheral surface of an outer peripheral iron core 20 while coming in contact with a central iron core 10. The connecting iron cores 11 to 13 do not come in contact with the outer peripheral iron core 20. Accordingly, the outer peripheral iron core 20 in FIG. 3A has a cylindrical shape. Further, end surfaces of the connecting iron cores 11 to 13 in FIG. 3A curve convexly along the inner peripheral surface of the outer peripheral iron core 20. Further, coils 51 to 53 are wound around the connecting iron cores 11 to 13 included in the connecting units 31 to 33.

Figure 3B:
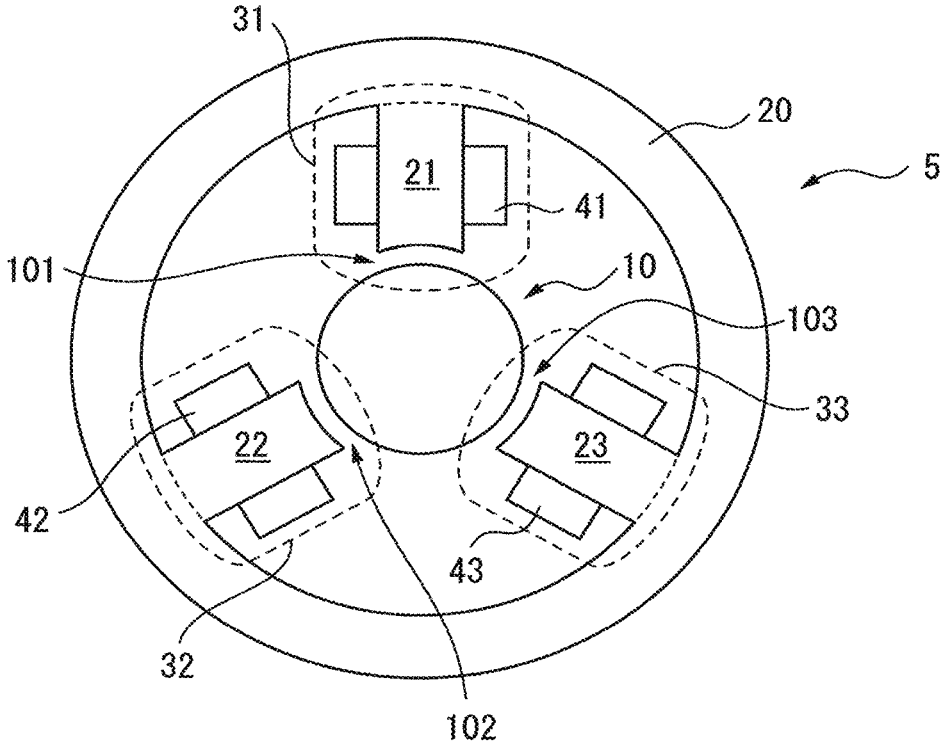
FIG. 3B is a cross-sectional view of another three-phase reactor according to the third embodiment of the present invention.

FIG. 3B is a cross-sectional view of another three-phase reactor according to the third embodiment of the present invention. Connecting units 31 to 33 in FIG. 3B include only connecting iron cores 21 to 23 but do not include connecting iron cores 11 to 13. The connecting iron cores 21 to 23 extend to the vicinity of the outer peripheral surface of a central iron core 10 while coming in contact with an outer peripheral iron core 20. The connecting iron cores 21 to 23 do not come in contact with the central iron core 10. Accordingly, the central iron core 10 in FIG. 3B has a cylindrical shape. Further, end surfaces of the connecting iron cores 21 to 23 in FIG. 3B curve concavely along the outer peripheral surface of the central iron core 10. Further, coils 41 to 43 are wound around the connecting iron cores 21 to 23 coming in contact with the outer peripheral iron core 20.

As illustrated in FIG. 3A and FIG. 3B, the connecting unit 31 may include either the connecting iron core 11 coming in contact with the central iron core 10 or the connecting iron core 21 coming in contact with the outer peripheral iron core 20. The same applied to the other connecting units 32 and 33. However, the sizes of gaps 101 to 103 do not vary even in such a case.

The outer peripheral iron core 20 having a cylindrical shape can be adopted in FIG. 3A, while the central iron core 10 having a cylindrical shape can be adopted in FIG. 3B. In other words, the central iron core 10 or the outer peripheral iron core 20 can have a cylindrical shape in the third embodiment. Accordingly, the three-phase reactor 5 can be allowed to have a simple configuration, and a manufacturing cost can also be reduced. It is obvious that effects similar to the effects described above can be obtained.

Figure 4:
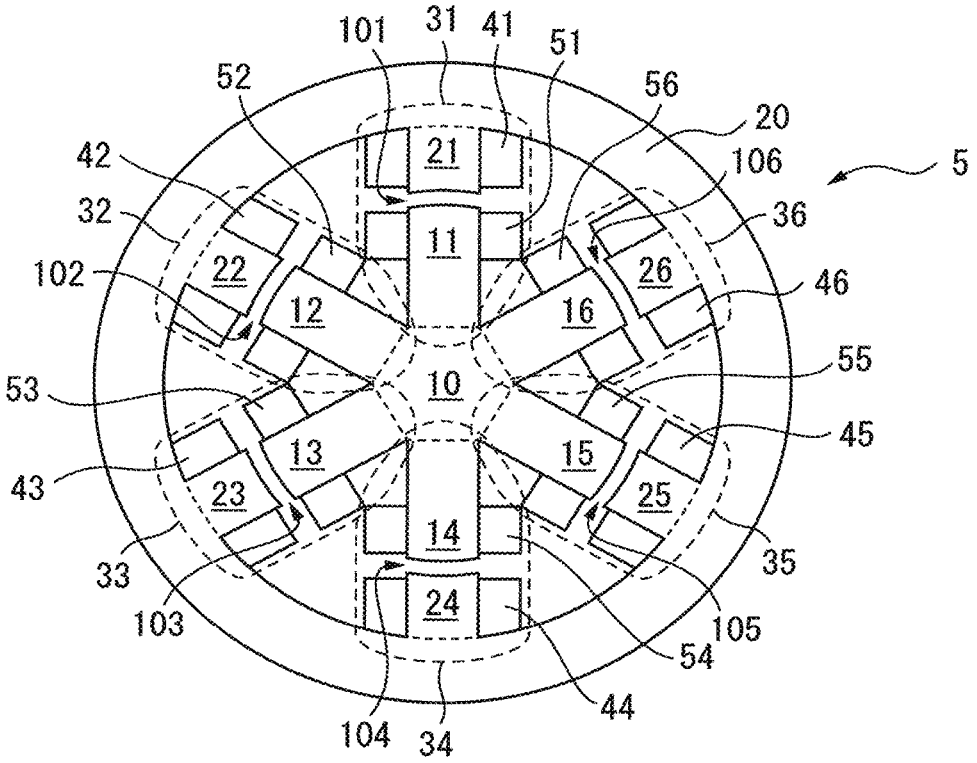
FIG. 4 is a cross-sectional view of a three-phase reactor according to a fourth embodiment of the present invention.

FIG. 4 is a cross-sectional view of a three-phase reactor according to a fourth embodiment of the present invention. The three-phase reactor 5 illustrated in FIG. 4 includes six connecting units 31 to 36. The connecting units 31 to 36 includes: six connecting iron cores 11 to 16 coming in contact with a central iron core 10; and six connecting iron cores 21 to 26 that surround the central iron core 10 and come in contact with an outer peripheral iron core 20. Accordingly, the connecting iron cores 11 to 16 and the connecting iron cores 21 to 26 are spaced from each other circumferentially at regular intervals, as described above. Further, gaps 101 to 106 that enable magnetic connection are formed between the connecting iron cores 11 to 16 and the connecting iron cores 21 to 26.

Three-phase reactor can be formed by appropriately connecting coils as described later as illustrated in FIG. 4. An end surface of the connecting iron core 11 included in the connecting unit 31 illustrated in FIG. 4 curves convexly along a circumferential direction, while an end surface of the connecting iron core 21 curves concavely along the circumferential direction. The same applies to the other connecting units 32 to 36. It is obvious that effects similar to the effects described above can also be obtained in such a case.

Figure 5A:
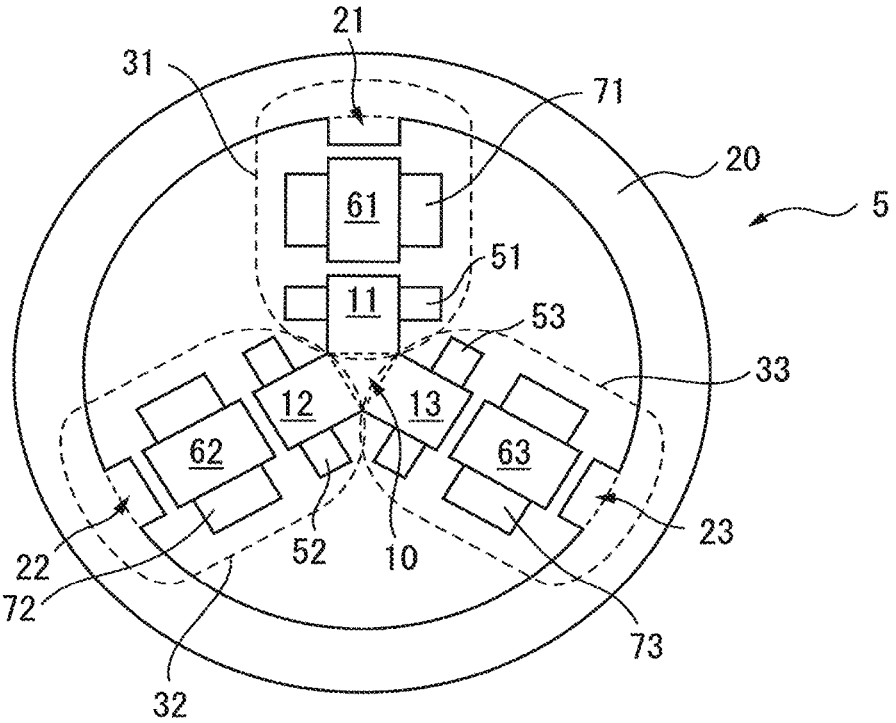
FIG. 5A is a first cross-sectional view of a three-phase reactor according to a fifth embodiment of the present invention.

FIG. 5A is a first cross-sectional view of a three-phase reactor according to a fifth embodiment of the present invention. The three-phase reactor 5 illustrated in FIG. 5A includes three connecting units 31 to 33. In FIG. 5A, the connecting units 31 to 33 include: connecting iron cores 11 to 13 coming in contact with a central iron core 10; connecting iron cores 21 to 23 coming in contact with an outer peripheral iron core 20; and connecting iron cores 61 to 63 arranged between the connecting iron cores 11 to 13 and the connecting iron cores 21 to 23. As illustrated in the drawing, the connecting iron cores 61 to 63 are spaced from both the connecting iron cores 11 to 13 and the connecting iron cores 21 to 23. Gaps that enable magnetic connection are formed between the connecting iron cores 11 to 13 and the connecting iron cores 61 to 63 and between the connecting iron cores 61 to 63 and the connecting iron cores 21 to 23.

Further, coils 51 to 53 are wound around the connecting iron cores 11 to 13 coming in contact with the central iron core 10, while no coils are wound around the connecting iron cores 21 to 23 coming in contact with the outer peripheral iron core 20. Instead, coils 71 to 73 are wound around the connecting iron cores 61 to 63. It is found that the inductance of the reactor 5 can be easily changed by exchanging the connecting iron cores 61 to 63 including the coils 71 to 73 having different winding numbers and cross-sectional areas with existing connecting iron cores 61 to 63 in such a configuration. It is obvious that effects similar to the effects described above can be obtained.

Figure 5B:
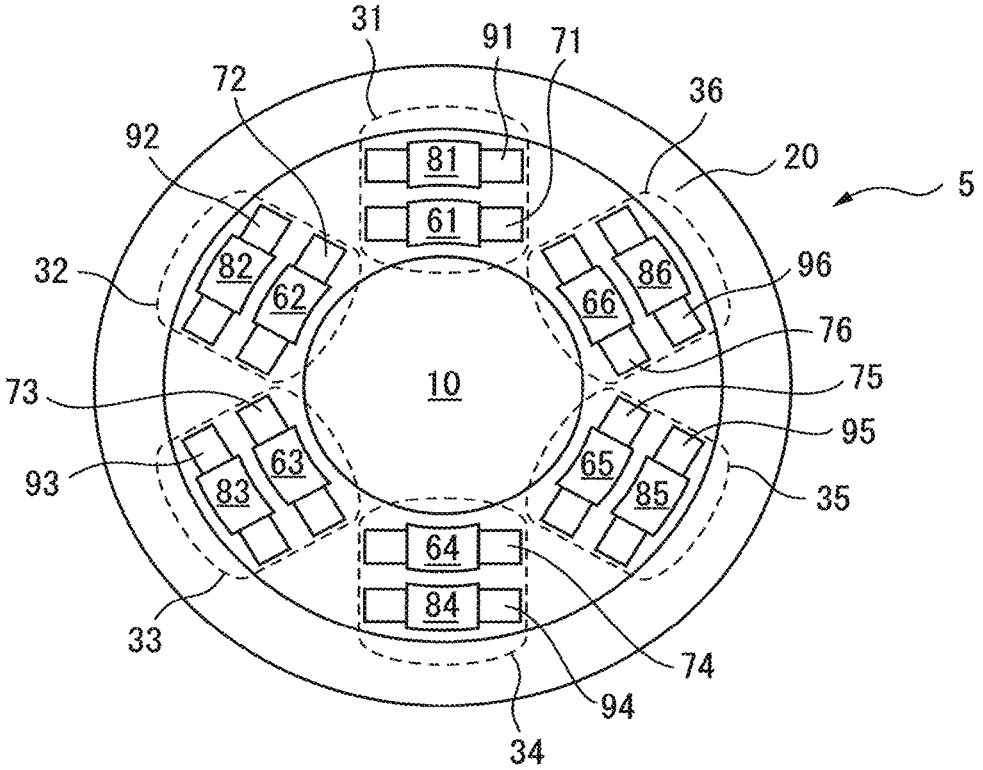
FIG. 5B is a second cross-sectional view of a three-phase reactor according to the fifth embodiment of the present invention.

FIG. 5B is a second cross-sectional view of the three-phase reactor according to the fifth embodiment of the present invention. The reactor 5 illustrated in FIG. 5B includes six connecting units 31 to 36. As can be seen from FIG. 5B, the connecting units 31 to 36 include connecting iron cores 61 to 66 located in the vicinity of a central iron core 10, and connecting iron cores 81 to 86 located in the vicinity of an outer peripheral iron core 20. Further, coils 71 to 76 are wound around connecting iron cores 61 to 66, while coils 91 to 96 are wound around connecting iron cores 81 to 86.

Both the connecting iron cores 61 to 66 and the connecting iron cores 81 to 86 are arranged between the central iron core 10 and the outer peripheral iron core 20. None of the connecting iron cores 61 to 66 and the connecting iron cores 81 to 86 comes in contact with both the central iron core 10 and the outer peripheral iron core 20. Gaps that enable magnetic connect are formed between the central iron core 10 and the connecting iron cores 61 to 66, between the connecting iron core 61 to 66 and the connecting iron core 81 to 86, and between the connecting iron core 81 to 86 and the outer peripheral iron core 20. Accordingly, each of the central iron core 10 and the outer peripheral iron core 20 illustrated in FIG. 5B has a cylindrical shape. As can be seen from FIG. 5B, the connecting iron cores 61 to 66 and the connecting iron cores 81 to 86 are spaced from each other circumferentially at regular intervals. A larger number of connecting iron cores may be included.

Figure 5C:
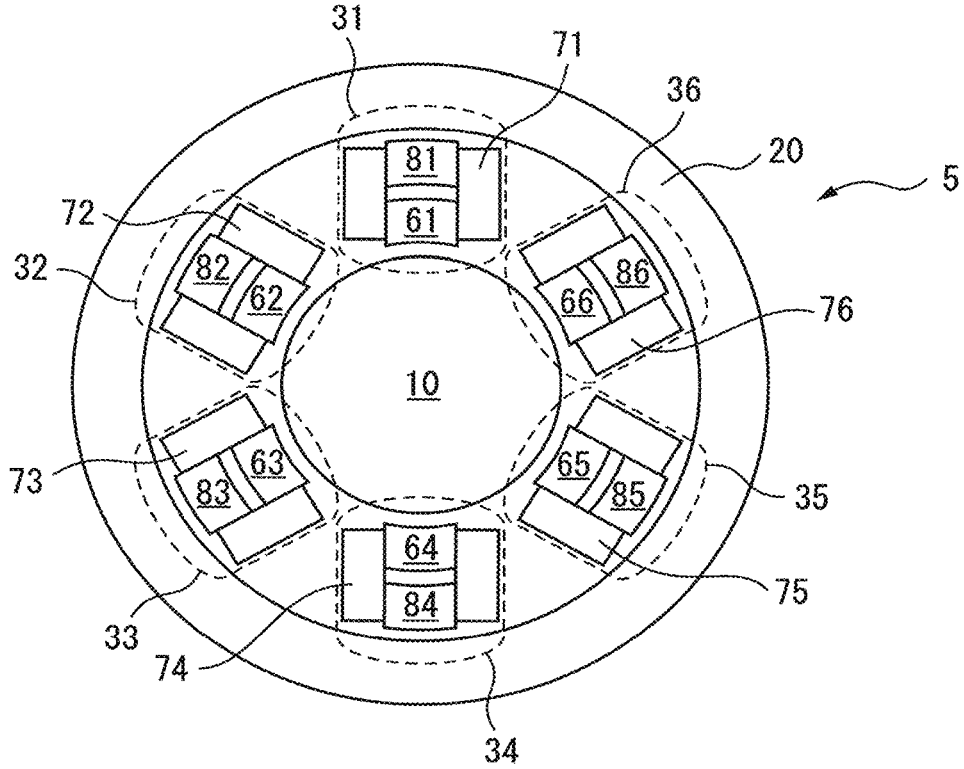
FIG. 5C is a third cross-sectional view of a three-phase reactor according to the fifth embodiment of the present invention.

FIG. 5C is a third cross-sectional view of a three-phase reactor according to the fifth embodiment of the present invention. FIG. 5C is the same as FIG. 5B except that common coils 71 to 76 are wound around connecting iron cores 61 to 66 and connecting iron cores 81 to 86.

In the embodiment illustrated in FIG. 5B and FIG. 5C, the central iron core 10 and the outer peripheral iron core 20 may be cylindrical to enable simplification of the configurations of the central iron core 10 and the outer peripheral iron core 20. The inductance of the reactor 5 can be easily changed by exchanging the connecting iron cores 61 to 66 and the connecting iron cores 81 to 86 including the coils having different winding numbers and cross-sectional areas with existing connecting iron cores. It is obvious that effects similar to the effects described above can be obtained.

Figure 6A:
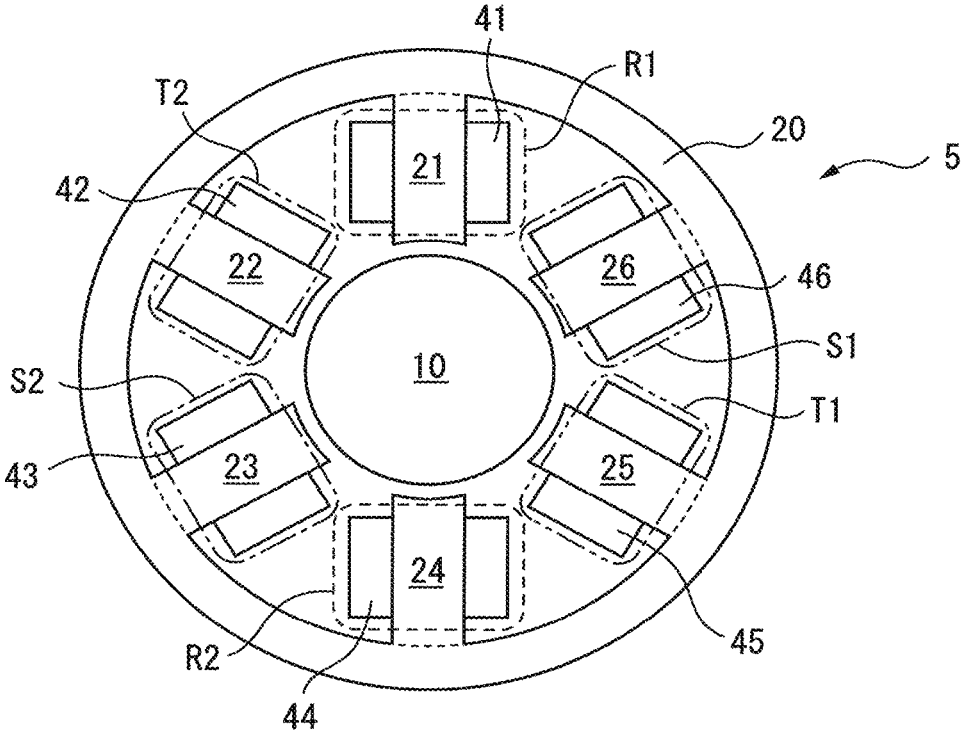
FIG. 6A is a cross-sectional view of a three-phase reactor according to a sixth embodiment of the present invention.
Figure 6B:
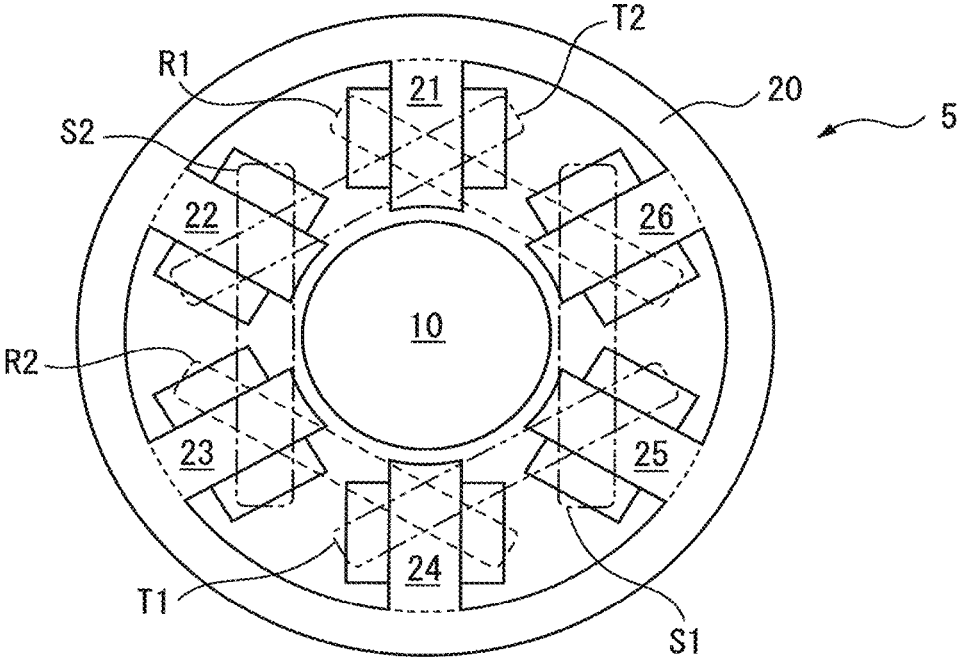
FIG. 6B is another cross-sectional view of the three-phase reactor according to the sixth embodiment of the present invention.

FIG. 6A is a cross-sectional view of a three-phase reactor according to a sixth embodiment of the present invention, and FIG. 6B is another cross-sectional view of the three-phase reactor according to the sixth embodiment of the present invention. In the drawings, the three-phase reactor 5 includes six connecting units. The connecting units include six connecting iron cores 21 to 26 coming in contact with an outer peripheral iron core 20. Coils 41 to 46 are wound around the connecting iron cores 21 to 26, respectively. End surfaces of the connecting iron cores 21 to 26 curve concavely.

In FIG. 6A, each coil is wound by concentrated winding. Accordingly, the coils 41 and 44 illustrated in FIG. 6A are R-phase coils R1 and R2, the coils 42 and 45 are T-phase coils T1 and T2, and the coils 43 and 46 are S-phase coils S1 and S2.

In contrast, in FIG. 6B, each coil is wound by distributed winding. Accordingly, a first R-phase coil is wound between the connecting iron cores 21 and 26, and a second R-phase coil is wound between the connecting iron cores 23 and 24, as illustrated in FIG. 6B. Similarly, a first T-phase coil is wound between the connecting iron cores 24 and 25, and a second T-phase coil is wound between the connecting iron cores 21 and 22. Similarly, a first S-phase coil is wound between the connecting iron cores 25 and 26, and a second S-phase coil is wound between the connecting iron cores 22 and 23.

Figure 7A:
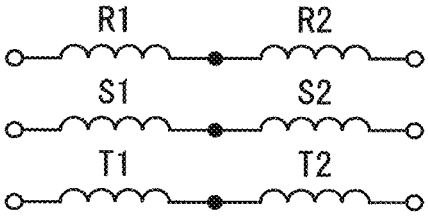
FIG. 7A is a circuit diagram of the three-phase reactor according to the sixth embodiment of the present invention.
Figure 7B:
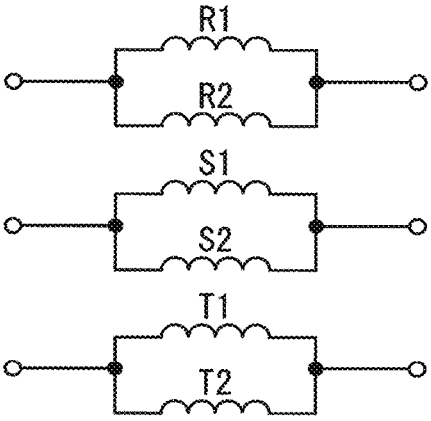
FIG. 7B is another circuit diagram of the three-phase reactor according to the sixth embodiment of the present invention.

FIG. 7A and FIG. 7B are circuit diagrams of the three-phase reactor of the sixth embodiment of the present invention. In FIG. 7A, the R-phase coil R1 and R-phase coil R2 described above are connected in series. The two T-phase coils T1 and T2 and the two S-phase coils S1 and S2 are similarly connected in series. In FIG. 7B, the R-phase coil R1 and R-phase coil R2 described above are connected in parallel. The two T-phase coils T1 and T2 and the two S-phase coils S1 and S2 are similarly connected in parallel.

The inductance value of the three-phase reactor 5 can be adjusted by switching a method of connecting coils between in series and in parallel in such a manner. For example, when the three-phase reactor 5 includes six connecting units 31 to 36, coils in the connecting units 31, 33, and 35 may be connected in series while coils in the connecting units 32, 34, and 36 may be connected in parallel. It is obvious that the inductance value can be similarly adjusted in such a case.

Figure 8:
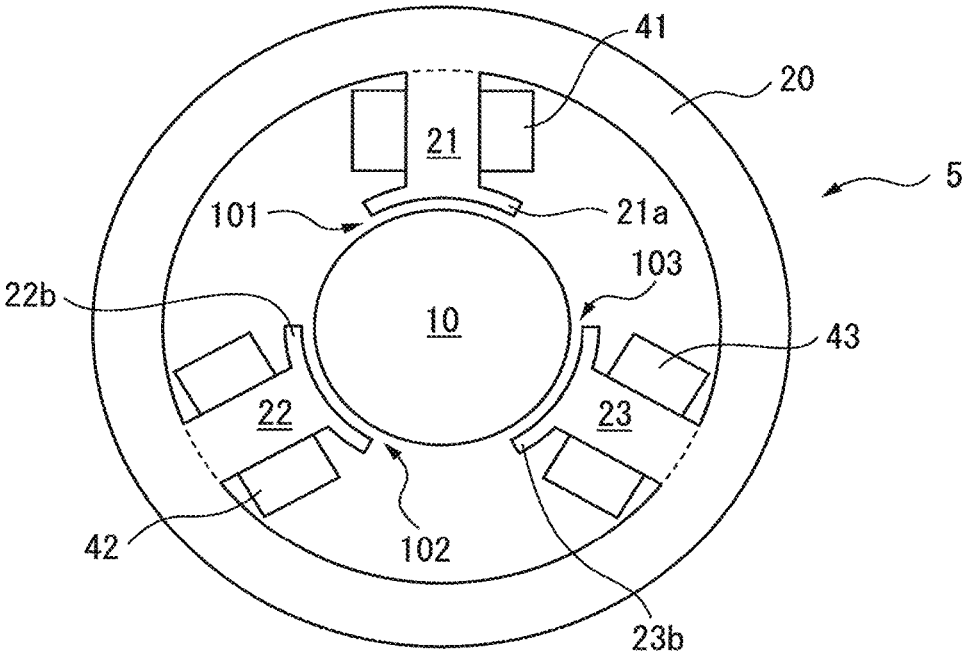
FIG. 8 is a cross-sectional view of a three-phase reactor according to a seventh embodiment of the present invention.

FIG. 8 is a cross-sectional view of a three-phase reactor according to a seventh embodiment of the present invention. The view is almost similar to FIG. 3B. In FIG. 8, extending units 21*a* to 23*a* that circumferentially extend are formed in the front ends of connecting iron cores 21 to 23 coming in contact with an outer peripheral iron core 20, respectively. The sizes of gaps between the extending units 21*a* to 23*a* and a central iron core 10 are equal to each other. In the eighth embodiment, the gaps 101 to 103 curve circumferentially, as illustrated in the drawing.

When the extending units 21*a* to 23*a* as described above are disposed, the areas of the gaps 101 to 103 on the connecting units 31 to 23 can be easily increased. A configuration in which extending units similar to those described above are included in the front ends of connecting iron cores 11 to 13 coming in contact with the central iron core 10 is acceptable. Alternatively, extending units may be disposed in both the connecting iron cores 11 to 13 coming in contact with the central iron core 10 and the connecting iron cores 21 to 23 coming in contact with the outer peripheral iron core 20. It is obvious that effects similar to the effects described above can be obtained.

Figure 9:
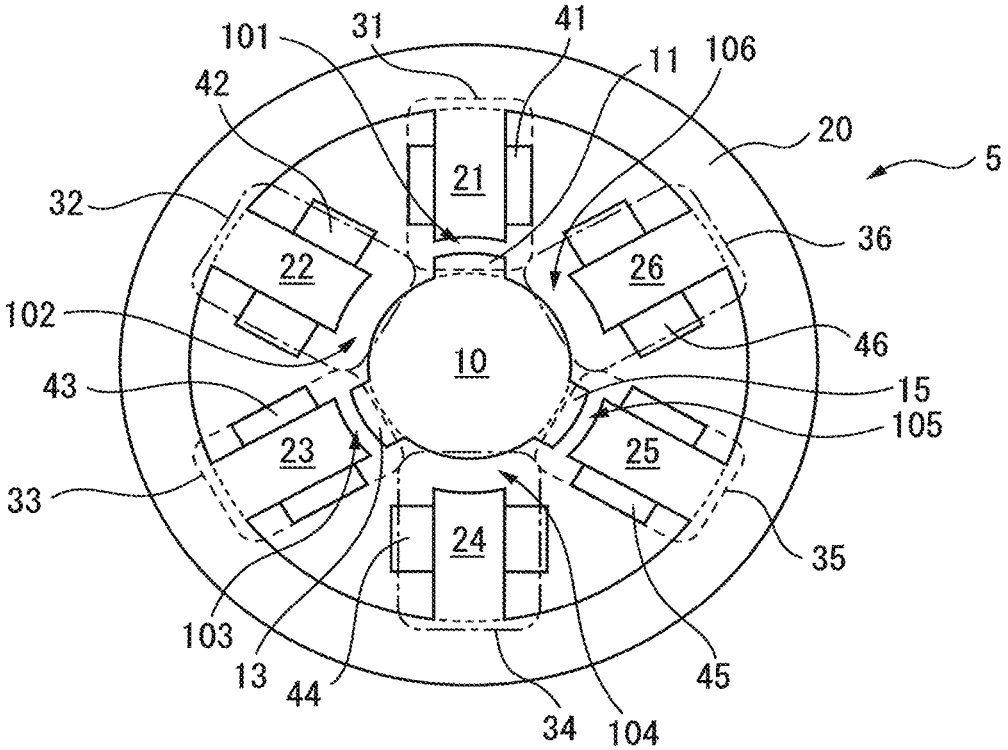
FIG. 9 is a cross-sectional view of a three-phase reactor according to an eighth embodiment of the present invention.

FIG. 9 is a cross-sectional view of a three-phase reactor according to an eighth embodiment of the present invention. The three-phase reactor 5 illustrated in FIG. 9 includes six connecting units 31 to 36. The connecting units 31 to 36 include: three connecting iron cores 11, 13, and 15 coming in contact with a central iron core 10; and six connecting iron cores 21 to 26 coming in contact with an outer peripheral iron core 20. The three connecting iron cores 11, 13, and 15, and the six connecting iron cores 21 to 26 are spaced from each other circumferentially at regular intervals. As can be seen from FIG. 9, the three connecting iron cores 21, 23, and 25 coming in contact with the outer peripheral iron core 20 face the three connecting iron cores 11, 13, and 15 coming in contact with the central iron core 10, respectively.

In the embodiment illustrated in FIG. 9, the connecting units 31, 33, and 35 and the connecting units 32, 34, and 36 are alternately arranged. The connecting units 31, 33, and 35 include: the connecting iron cores 11, 13, and 15 coming in contact with the central iron core 10; and the connecting iron cores 21, 23, and 25 coming in contact with the outer peripheral iron core 20. In contrast, the connecting units 32, 34, and 36 include only the connecting iron cores 22, 24, and 26 coming in contact with the outer peripheral iron core 20.

Because only the connecting iron cores 11, 13, and 15 come in contact with the central iron core 10, the sizes of gaps 101, 103, and 105 of the connecting units 31, 33, and 35 are smaller than the sizes of gaps 102, 104, and 106 of the connecting units 32, 34, and 36. As can be seen from FIG. 9, the cross-sectional areas of coils 41, 43, and 45 wound around the connecting iron cores 21, 23, and 25 are smaller than the cross-sectional areas of coils 42, 44, and 46 wound around the connecting iron cores 22, 24, and 26. Further, the winding numbers of the coils 41, 43, and 45 are intended to differ from the winding numbers of the coils 42, 44, and 46.

As can be seen from FIG. 9, the sizes of the corresponding gaps 101, 103, and 105 of the connecting units 31, 33, and 35 are equal to each other, and the sizes of the corresponding gaps 102, 104, and 106 of the connecting units 32, 34, and 36 are equal to each other. Similarly, the winding numbers and cross-sectional areas of the coils 41, 43, and 45 of the connecting units 31, 33, and 35 are equal to each other, and the winding numbers and cross-sectional areas of the coils 42, 44, and 46 of the connecting units 32, 34, and 36 are equal to each other.

In such a case, for example, the connecting units 31, 33, and 35 indicated by broken lines are defined as a first set, and the connecting units 32, 34, and 36 indicated by alternate long and short dash lines are defined as a second set. In other words, the three-phase reactor 5 illustrated in FIG. 9 includes the two sets of the connecting units. It is preferable to assign R-phase, T-phase, and S-phase coils to each of the first and second sets.

Figure 10:
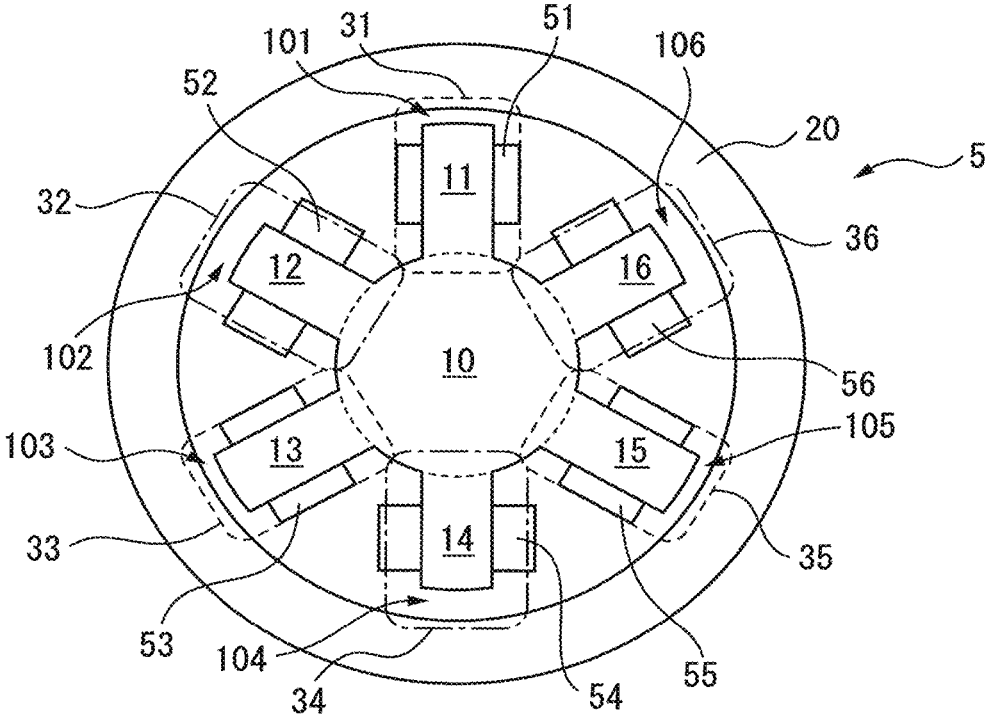
FIG. 10 is a cross-sectional view of a three-phase reactor according to a ninth embodiment of the present invention.

FIG. 10 is a cross-sectional view of another three-phase reactor according to a ninth embodiment of the present invention. The three-phase reactor 5 illustrated in FIG. 10 includes six connecting units 31 to 36. The connecting units 31 to 36 are spaced from each other circumferentially at regular intervals, and include only six connecting iron cores 11 to 16 coming in contact with a central iron core 10.

In the embodiment illustrated in FIG. 10, the connecting units 31, 33, and 35 and the connecting units 32, 34, and 36 are alternately arranged. The connecting iron cores 11, 13, and 15 in the connecting units 31, 33, and 35 are longer than the connecting iron cores 12, 14, and 16 in the connecting units 32, 34, and 36.

Accordingly, the sizes of gaps 101, 103, and 105 of the connecting units 31, 33, and 35 are smaller than the sizes of gaps 102, 104, and 106 of the connecting units 32, 34, and 36. As can be seen from FIG. 10, the cross-sectional areas of coils 51, 53, and 55 wound around the connecting iron cores 11, 13, and 15 are smaller than the cross-sectional areas of coils 52, 54, and 56 wound around the connecting iron cores 12, 14, and 16. Further, the winding numbers of the coils 51, 53, and 55 are intended to differ from the winding numbers of the coils 52, 54, and 56.

In such a case, for example, the connecting units 31, 33, and 35 indicated by broken lines are also defined as a first set, and the connecting units 32, 34, and 36 indicated by alternate long and short dash lines are also defined as a second set. It is preferable to assign R-phase, T-phase, and S-phase coils to each of the first and second sets, as described above. In the configurations illustrated in FIG. 9 and FIG. 10, it is also obvious that effects similar to the effects described above can be obtained.

Figure 13:
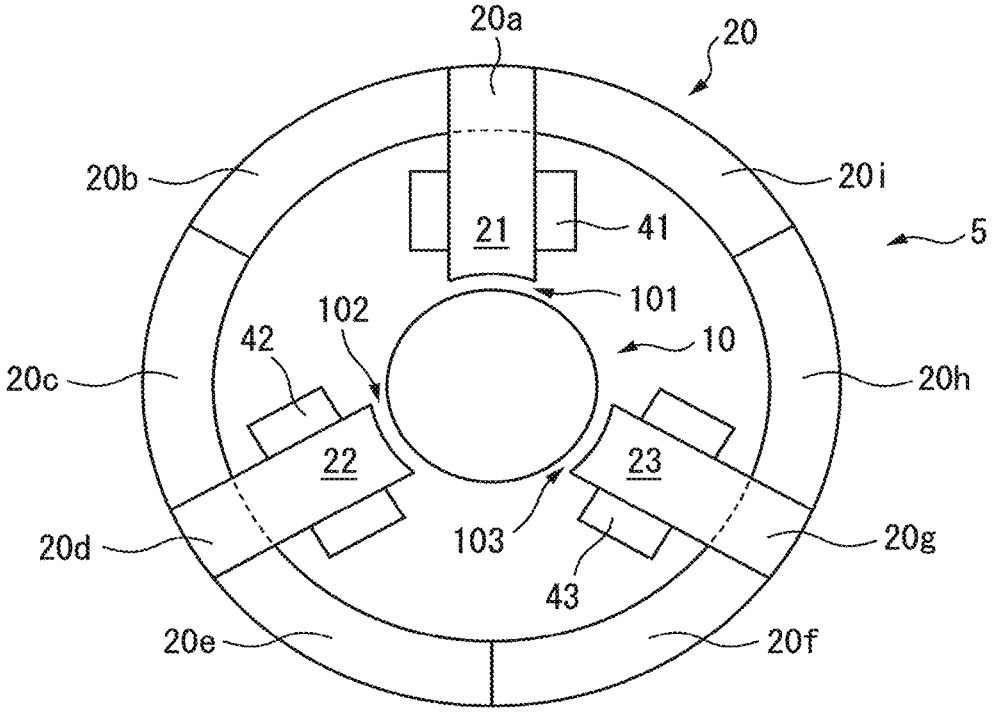
FIG. 13 is a cross-sectional view of a three-phase reactor according to a tenth embodiment of the present invention.

FIG. 13 is a cross-sectional view of another three-phase reactor according to a tenth embodiment of the present invention. The configuration of the three-phase reactor 5 illustrated in FIG. 13 is almost similar to that illustrated in FIG. 3B. However, an outer peripheral iron core 20 is divided into plural outer peripheral iron core units 20*a*, 20*b*, 20*c*, 20*d*, 20*e*, 20*f*, 20*g*, 20*h*, and 20*i* that are connected to each other. The outer peripheral iron core is divided into the plural units at optional places, thereby providing the effect of reducing waste pieces during manufacturing to decrease a material cost. The plural outer peripheral iron core units 20*a* to 20*i* are used, and therefore, the effect of facilitating assembly of the large outer peripheral iron core 20 is provided even when the produced outer peripheral iron core 20 is large.

Figure 14:
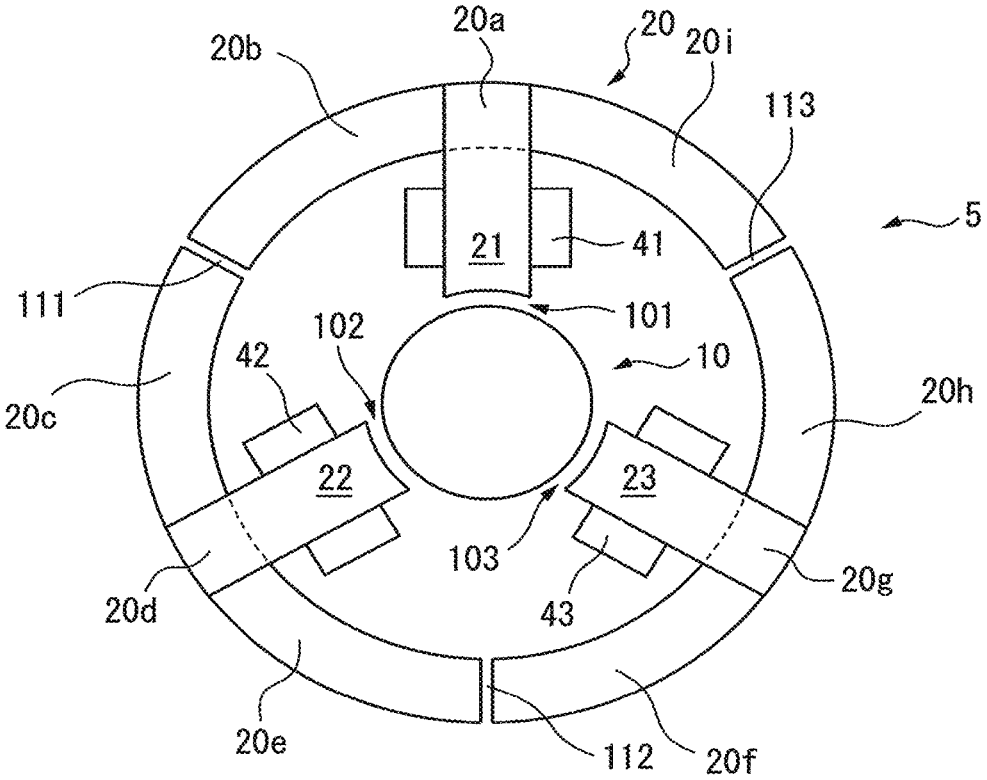
FIG. 14 is a cross-sectional view of a three-phase reactor according to an eleventh embodiment of the present invention.

FIG. 14 is a cross-sectional view of another three-phase reactor according to an eleventh embodiment of the present invention. The view is similar to FIG. 13. In FIG. 14, an outer peripheral iron core 20 is divided into plural outer peripheral iron core units 20*a*, 20*b*, 20*c*, 20*d*, 20*e*, 20*f*, 20*g*, 20*h*, and 20*i*. Outer peripheral gaps 111, 112, and 113 that enable magnetic connection are formed between the outer peripheral iron core units 20*b* and 20*c*, between the outer peripheral iron core units 20*e* and 20*f*, and between the outer peripheral iron core units 20*h* and 20*i*, respectively. The effect of facilitating adjustment of the imbalance of an inductance is provided by disposing the outer peripheral gaps 111, 112, and 113 in the outer peripheral iron core 20.

Figure 11A:
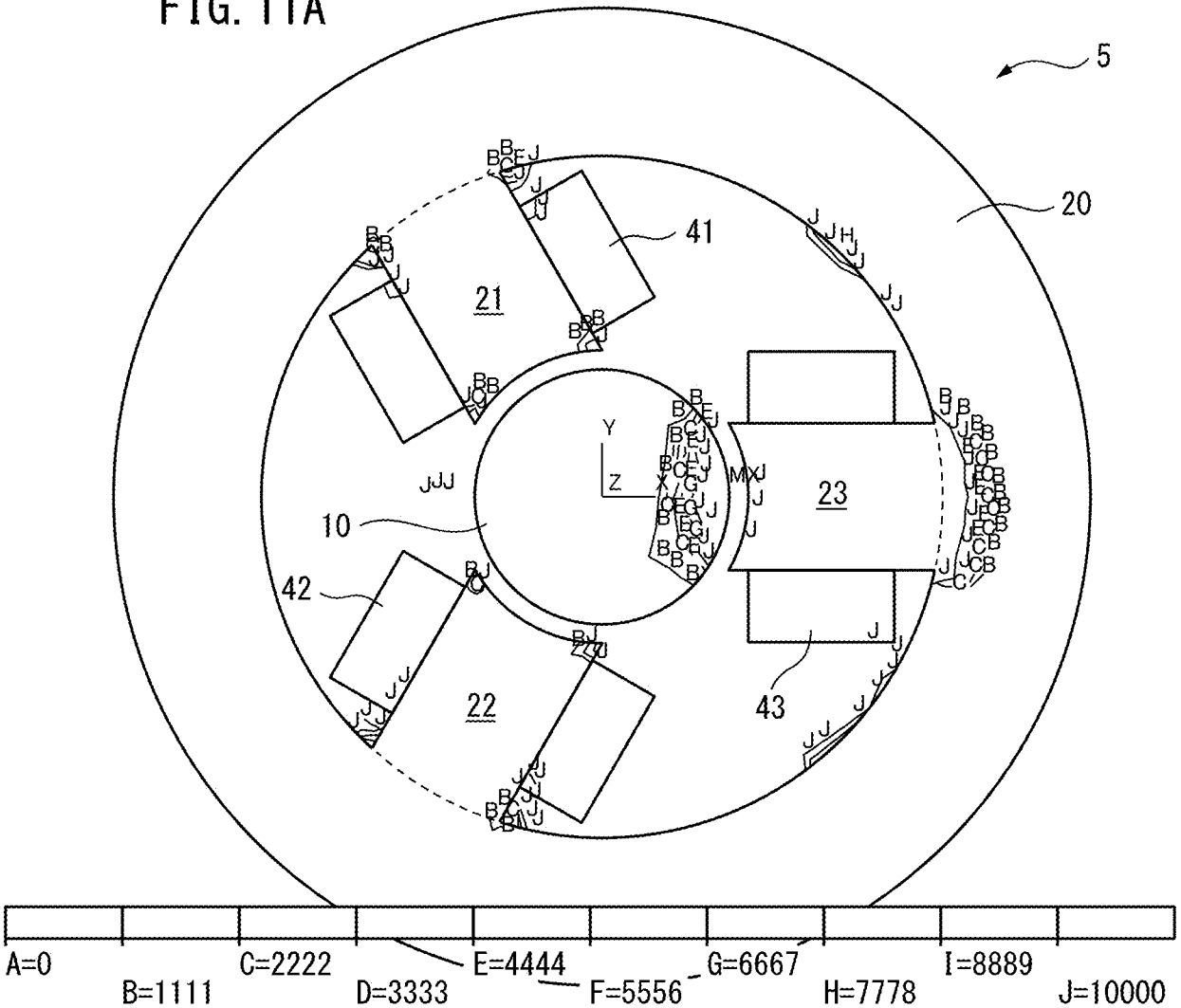
FIG. 11A is a view illustrating the magnetic field of the three-phase reactor illustrated in FIG. 3B.
Figure 11B:
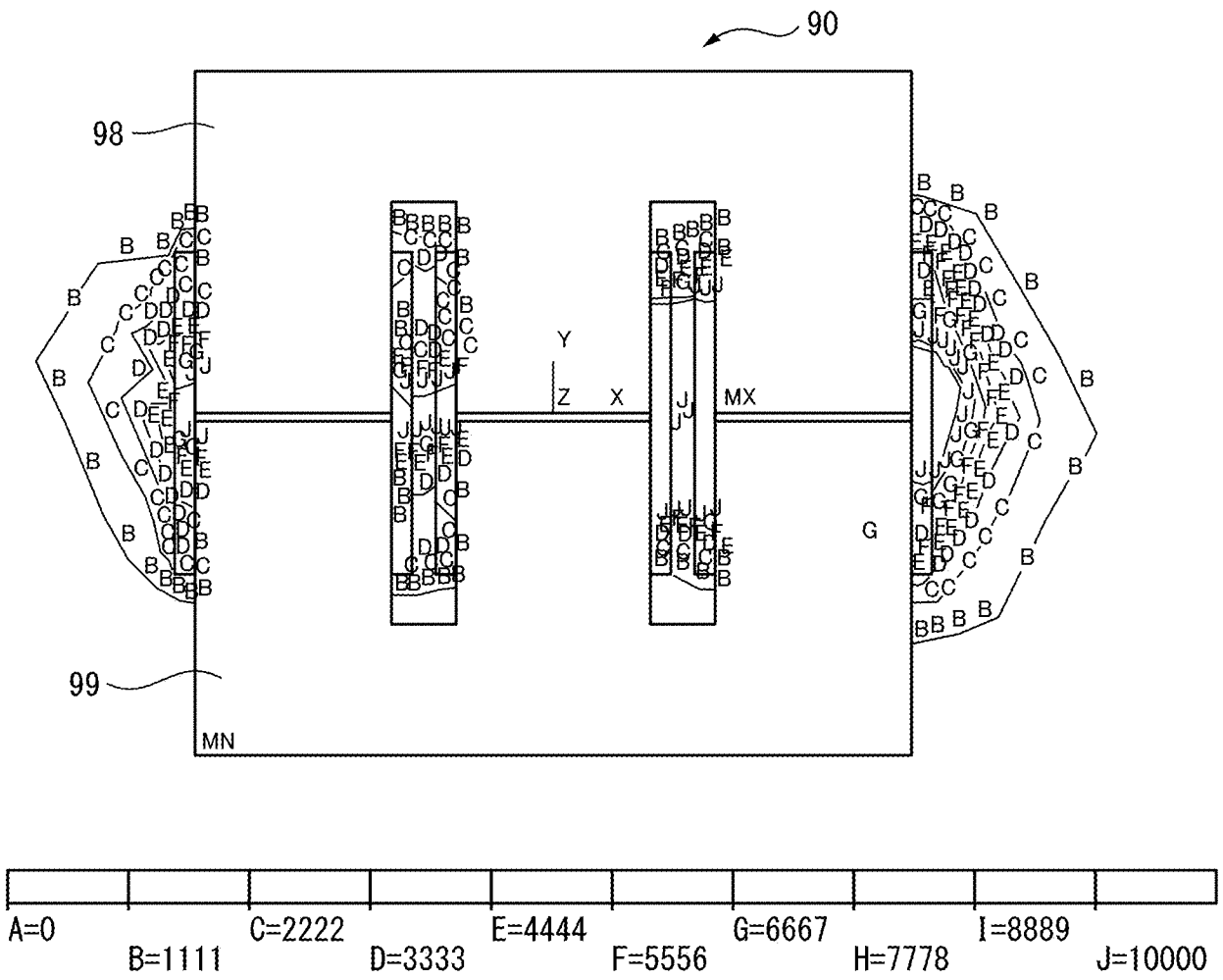
FIG. 11B is a view illustrating the magnetic field of a conventional three-phase reactor.

FIG. 11A is a view illustrating the magnetic field of the three-phase reactor illustrated in FIG. 3B, and FIG. 11B is a view illustrating the magnetic field of a conventional three-phase reactor. In FIG. 11A, magnetic fields leak out in the vicinity of the rear end of each of the connecting iron cores 21 to 23, and between the central iron core 10 and the front end of the connecting iron core 23. However, all of such magnetic fields leak out in the interior of the outer peripheral iron core 20, and the magnetic fields do not leak out to the outside of the outer peripheral iron core 20.

A three-phase reactor 90 illustrated in FIG. 11B includes two iron-core units 98 and 99 including concave units. As illustrated in FIG. 11B, magnetic fields leak out not only in the interiors of the concave units of the iron-core units 98 and 99 but also to the outside of the iron-core units 98 and 99. In other words, magnetic fields leak out to the outside of the three-phase reactor 90 in the conventional technology. Accordingly, it is found that the three-phase reactor 5 in the present invention has the prominent effect of enabling prevention of leakage of a magnetic field.

Figure 12A:
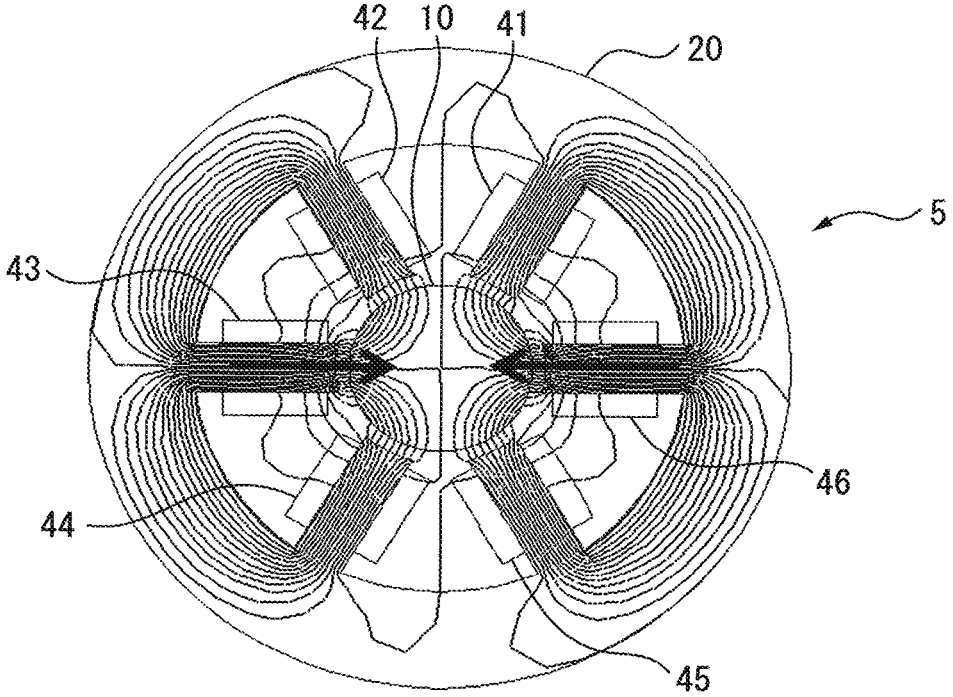
FIG. 12A is a first view illustrating magnetic flux directions in a three-phase reactor.
Figure 12B:
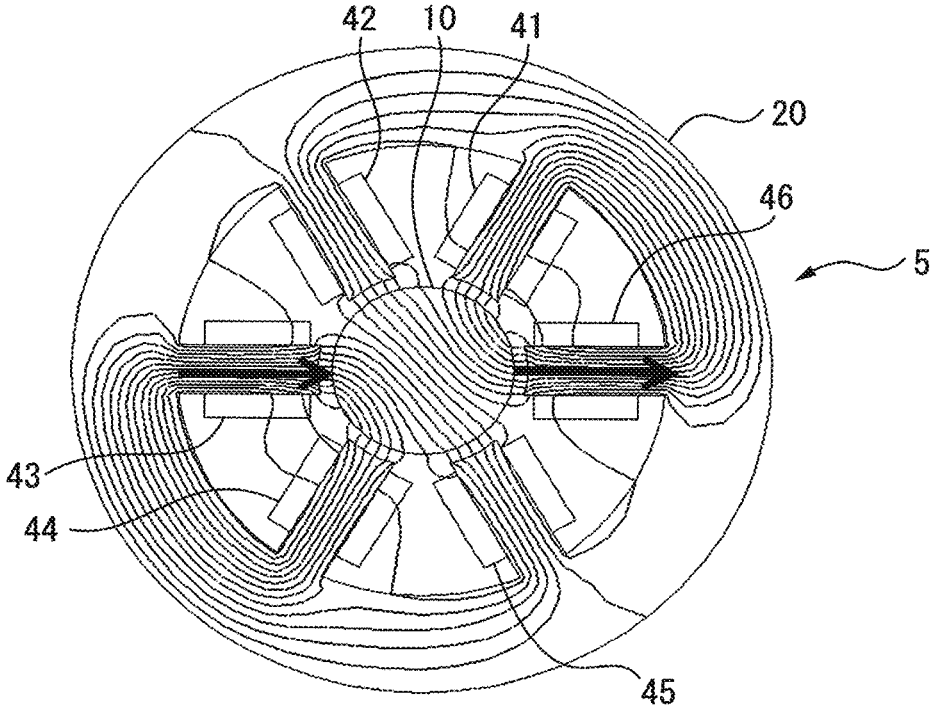
FIG. 12B is a second view illustrating magnetic flux directions in the three-phase reactor.

FIG. 12A and FIG. 12B are views illustrating magnetic flux directions in still another three-phase reactor. The three-phase reactor 5 illustrated in the views includes: a central iron core 10 having a generally cylindrical shape; and an outer peripheral iron core 20 with which six connecting iron-core units spaced from each other circumferentially at regular intervals come in contact. Coils 41 to 46 are wound around the six connecting iron-core units.

In FIG. 12A, the coils 41 and 44 are T-phase coils, the coils 42 and 45 are R-phase coils, and coils 43 and 46 are S-phase coils. In a three-phase alternating current, the largest current passes through the S-phase coils 43 and 46 while a current that is −½ time the largest current passes through the T-phase coils 41 and 44 and the R-phase coils 42 and 45. In FIG. 12A, the magnetic fluxes of the two S-phase coils 43 and 46 are directed at the center of the three-phase reactor 5. In other words, in the three-phase reactor 5 of the present invention, magnetic fluxes typically concentrate at the center of the three-phase reactor 5. The total of the magnetic fluxes at the center of the three-phase reactor 5 is zero in a three-phase alternating current.

In FIG. 12B, the coil 41 is a T-phase coil, the coil 42 is a −R-phase coil, the coil 43 is a −S-phase coil, the coil 44 is a −T-phase coil, the coil 45 is an R-phase coil, and the coil 46 is an S-phase coil. In a three-phase alternating current, the largest current passes through the S-phase coil 46 while a current that is −½ time the largest current passes through the T-phase coil 41 and the R-phase coil 45. A current of which the magnitude is the same as that in the opposite direction is intended to pass through a coil with the sign "−". As illustrated in FIG. 12B, the magnetic flux of the coil 43 which is "−S-phase coil" is directed at the center of the three-phase reactor 5. The magnetic flux of the coil 46 which is "S-phase coil" is directed in a radial direction at the outside of the three-phase reactor 5.

Because the three-phase reactor 5 is a stationary instrument, the sequence of the coils may be changed as illustrated in FIG. 12A and FIG. 12B. In other words, the sequence of the coils can be selected as appropriate depending on features demanded for the three-phase reactor 5.

ADVANTAGEOUS EFFECTS OF INVENTION

In the first and second aspects of the present invention, because the connecting units are arranged around the central iron core, the magnetic flux of the coil concentrates from each connecting unit toward the central iron core, and approximates zero in the central iron core, and high-frequency noise can also be greatly reduced. Differences in magnetic path lengths between phases be less than those in conventional structures, and an imbalance in inductances caused by the differences in the magnetic path lengths can be reduced. Further, because the connecting units are arranged around the central iron core, an imbalance in magnetic fluxes generated from the coils of the connecting units bes less than that in the conventional structures, and an imbalance in inductances caused by the imbalance in the magnetic fluxes can be reduced. Further, because the central iron core is surrounded by the outer peripheral iron core, a magnetic field is prevented from leaking out to the outside of the outer peripheral iron core.

In the third aspect of the present invention, the central iron core and the outer peripheral iron core with cylindrical shapes, which can be easily produced, can be adopted.

In the fourth aspect of the present invention, components can be reduced by integrating parts of the connecting units with the central iron core or the outer peripheral iron core.

In the fifth aspect of the present invention, a simple configuration can be made because either the central iron core or the outer peripheral iron core, which is not integrated with the connecting units, or both thereof can have a cylindrical shape.

In the sixth or seventh aspect of the present invention, the three-phase reactor having a simple configuration can be produced.

In the eighth aspect of the present invention, the inductance values of the three-phase reactor can be adjusted by combining connections in series and/or in parallel.

In the ninth aspect of the present invention, the area of a gap can be easily increased.

In the tenth aspect of the present invention, plural reactors can be arranged in a narrower installation space in one reactor by configuring the plural reactors in the structure of the one reactor, or an inductance value can be adjusted by connecting the plural reactors in series or in parallel.

In the eleventh aspect of the present invention, the effect of reducing the imbalance in the inductances caused by the magnetic path lengths in the first aspect of the present invention, and the effect of reducing the imbalance in the inductances caused by the arrangement of the coils are maximized by arranging the connecting units rotationally symmetrically with respect to the central iron core.

In the twelfth aspect of the present invention, productability and assembly properties are improved by dividing the outer peripheral iron core into the plural outer peripheral iron core units.

In the thirteenth aspect of the present invention, adjustment of an inductance is facilitated by disposing the outer peripheral gap.

Although the present invention has been described with reference to the exemplary embodiments, persons skilled in the art will understand that the changes described above as well as various other changes, omissions, and additions may be made without departing from the scope of the present invention. The described rotation symmetry refers to a symmetric shape or arrangement that enables the problems to be solved.

The invention claimed is:

1. A three-phase reactor having a center axis, comprising:

a central iron core located at the center axis;

an outer peripheral iron core surrounding and concentric with the central iron core; and at least three connecting units located between the central iron core and the outer peripheral iron core, the at least three connecting units magnetically connect the central iron core and the outer peripheral iron core to each other, wherein the at least three connecting units are spaced from each other circumferentially at regular intervals, wherein each of the connecting units comprises at least one connecting iron core, at least one coil wound around the at least one connecting iron core, and at least one gap at each end of the at least one connecting iron core so that the at least one connecting iron core does not come into contact with the central iron core and the outer peripheral iron core;

wherein the at least one coil of each of the connecting units are connected either in series or in parallel and adjust the inductance of the reactor; and wherein the connecting units are spaced from both the central iron core and the outer peripheral iron core.

2. The three-phase reactor according to claim 1, wherein the connecting units come in contact with only either the central iron core or the outer peripheral iron core, or the connecting units are integrated with either the central iron core or the outer peripheral iron core.

3. The three-phase reactor according to claim 1, wherein the plurality of coils exist and are connected in at least either series or parallel.

4. The three-phase reactor according to claim 1, wherein an extending unit that circumferentially extends is disposed on at least one end of each of the connecting units.

* * * * *